US008733026B1

(12) United States Patent
Wei

(10) Patent No.: US 8,733,026 B1
(45) Date of Patent: May 27, 2014

(54) DOOR ASSEMBLY

(71) Applicant: Ideal Sanitary Ware Co., Ltd., Guangdong (CN)

(72) Inventor: Wuxiang Wei, Guangdong (CN)

( * ) Notice: Subject to any disclaimer, the term of this patent is extended or adjusted under 35 U.S.C. 154(b) by 0 days.

(21) Appl. No.: 13/917,775

(22) Filed: Jun. 14, 2013

(30) Foreign Application Priority Data

May 13, 2013 (CN) ..... 2013 2 0256689

(51) Int. Cl.
*A47K 3/28* (2006.01)
*E06B 1/20* (2006.01)

(52) U.S. Cl.
USPC ..... 49/505

(58) Field of Classification Search
CPC ..... A47K 3/34; A47K 3/30; E06B 1/6076; E06B 1/18; E06B 1/10; E06B 1/20
USPC ..... 49/504, 505; 52/126.1, 126.3, 52/656.1–656.9
See application file for complete search history.

(56) References Cited

U.S. PATENT DOCUMENTS

| | | | | | |
|---|---|---|---|---|---|
| 924,176 | A * | 6/1909 | Moen | 49/505 |
| 1,496,525 | A * | 6/1924 | Coco | 52/217 |
| 1,813,753 | A * | 7/1931 | McNolty | 49/505 |
| 2,739,674 | A * | 3/1956 | Casebolt | 49/505 |
| 2,856,040 | A * | 10/1958 | Dansereau | 49/408 |
| 3,553,891 | A * | 1/1971 | Casebolt | 49/505 |
| 3,956,855 | A * | 5/1976 | Walker | 49/504 |
| 4,453,346 | A * | 6/1984 | Powell et al. | 49/404 |
| 4,750,310 | A * | 6/1988 | Holcombe | 52/844 |
| 5,063,638 | A * | 11/1991 | Howard et al. | 16/238 |
| 5,918,659 | A * | 7/1999 | Lee | 160/199 |
| 6,035,460 | A * | 3/2000 | Borter | 4/607 |
| 6,152,080 | A * | 11/2000 | Allen | 119/452 |
| 6,701,672 | B2 * | 3/2004 | Teubert et al. | 49/505 |
| 6,792,721 | B1 * | 9/2004 | Montanari | 52/35 |
| 6,895,714 | B2 * | 5/2005 | Teubert et al. | 49/505 |
| 7,159,362 | B2 * | 1/2007 | Chen | 49/505 |
| 7,331,146 | B1 * | 2/2008 | Beutler et al. | 52/204.56 |
| 7,987,637 | B2 * | 8/2011 | Smith | 52/126.1 |
| 2003/0019030 | A1 * | 1/2003 | Kopacz et al. | 4/607 |
| 2003/0046885 | A1 * | 3/2003 | Tavivian | 52/204.1 |
| 2008/0229675 | A1 * | 9/2008 | Self et al. | 52/35 |
| 2009/0120004 | A1 * | 5/2009 | Cobb | 49/381 |

* cited by examiner

*Primary Examiner* — Katherine Mitchell
*Assistant Examiner* — Justin Rephann
(74) *Attorney, Agent, or Firm* — Nixon Peabody LLP; Jeffrey L. Costellia

(57) ABSTRACT

A door assembly is provided which comprises a stationary frame and a movable frame, wherein the door assembly further comprises an adjusting assembly for fixing and adjusting the movable frame. The adjusting assembly comprises a fixing element disposed at one end of the fixing frame and including an engagement element on which a first groove is formed, an adjusting element disposed at one end of the movable frame and including a first through hole corresponding to the first groove and a cavity for receiving the engagement element, and a locking member comprising a handle portion and a rotation portion which can go through the first through hole such that at least one part of the rotation portion can reach in the first groove.

10 Claims, 5 Drawing Sheets

DOOR ASSEMBLY

CROSS-REFERENCE TO RELATED APPLICATION

The present invention claims priority benefits from Chinese utility model application No. 201320256689.5 filed on May 13, 2013, the disclosure of which is hereby incorporated herein by reference.

FIELD OF THE INVENTION

The present invention relates to a door assembly, and in particular, to an adjusting assembly used therein for the adjusting of a stationary frame and a movable frame of the door assembly.

BACKGROUND OF THE INVENTION

Doors, such as shower doors or balcony doors, are often mounted against wall surfaces and the doors thus mounted are kept as vertical as possible. However, the wall surfaces of buildings are often not exactly vertical, for example, titled toward outside/inside by an angle. Therefore, if the doors are mounted completely along the wall surface, the doors may not be smoothly opened or closed. In this regard, it is necessary to adjust the distances between the top/bottom end of a door and a wall surface so as to keep the door in a vertical position.

To achieve this adjustment, a door assembly usually comprises a stationary frame to be attached to a wall surface, and a movable frame connected with a door panel, such as a glass door panel. The stationary frame is firstly attached to the wall surface and then the movable frame is moved toward the stationary frame, during which the distances between the top and bottom ends of the movable frame, and the stationary frame are such adjusted that the movable frame is in a vertical position, and in turn, the door panel is also in a vertical position. The stationary and movable frames are finally connected to each other by drilling thereon and by using fasteners.

However, in one aspect, the drilling operation requires at least two people to cooperate and is very time-consuming. In another aspect, the drilling may inadvertently cause damages to the surfaces of the frames (generally made of aluminum materials), which is undesirable to consumers.

SUMMARY OF THE INVENTION

An object of the present invention is to provide a door assembly which can be mounted without drilling. Another object of the invention is to provide a door assembly that can be mounted by a single person.

To achieve the objectives above, a door assembly is provided which comprises a stationary frame and a movable frame, wherein the door assembly further comprises an adjusting assembly for fixing and adjusting the movable frame. The adjusting assembly comprises a fixing element disposed at one end of the fixing frame and including an engagement element on which a first groove is formed, an adjusting element disposed at one end of the movable frame and including a first through hole corresponding to the first groove and a cavity for receiving the engagement element, and a locking member comprising a handle portion and a rotation portion which can go through the first through hole such that at least one part of the rotation portion can reach in the first groove. The adjusting element is movable with respect to the fixing element when the handle portion is forced such that the locking member is in an opening position, and the rotation portion can cause outer sidewalls of the engagement element to engage with inner sidewalls of the cavity to lock the adjusting element when the handle portion is forced such that the locking member is in a locking position.

The movable frame can be connected to the fixing frame and can be adjusted relative to the fixing frame by the adjusting assembly such that the door assembly provided in the present invention can be assembled without drilling operation, minimizing risk of damage to the frames, and can be assembled by a single person.

In one embodiment of the present invention, the rotation portion has a cross section in shape of rectangle or ellipse.

In one embodiment of the present invention, the outer sidewalls of the engagement element and the inner sidewalls of the cavity have teeth respectively which are cooperating with each other to prevent the adjusting element from displacing relative to the fixing element in case of excessive force applied, i.e., to obtain a reliable engagement.

In one embodiment of the present invention, the fixing element further includes a fixing plate perpendicular to the engagement element and connected to the fixing frame by a fastener. In a preferred embodiment, a guiding portion is disposed at two sides of the fixing plate, and a second groove is formed inside the fixing frame, the guiding portion being insertable into the second groove to initially position the fixing element.

In one embodiment of the present invention, a protrusion is disposed on the adjustable element, and a third groove is formed inside the movable frame, the protrusion being insertable into the third groove to attach the adjusting element to the movable frame. In a preferred embodiment, the third groove include two lateral walls and a transverse wall in which a second through hole is formed, and a snapping member is disposed on the protrusion, the snapping member being insertable into the second through hole to prevent the adjusting element from displacing relative to the movable frame.

In one embodiment of the present invention, the adjusting element further includes a shaft hole cooperating with a rotation shaft of a door such that the door is rotatable about the rotation shaft.

In one embodiment of the present invention, the door assembly further comprises a cap for partly surrounding the adjusting assembly to prevent water or dust from entering into the adjusting assembly. Specifically, a lug is disposed on a side surface of the cavity, and correspondingly a slot is formed in an outer wall of the adjusting element, the lug being insertable into the slot such that the cap can be attached to the adjusting element.

In one embodiment of the present invention, the door assembly is shower door assembly or balcony assembly.

DETAILED DESCRIPTION OF THE INVENTION

The present invention will now be described in more detail in reference to the drawings. It should be noted that the terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" include any and all combinations of one or more of the associated listed items. It will be further understood that the terms "comprises" "comprising" "includes" and/or "including" when used herein, specify the presence of stated features, integers, steps, operations, elements, and/or components, but do not preclude the presence or addition of one or more other features, integers, steps, operations, elements, components, and/or groups thereof.

Figure 1:
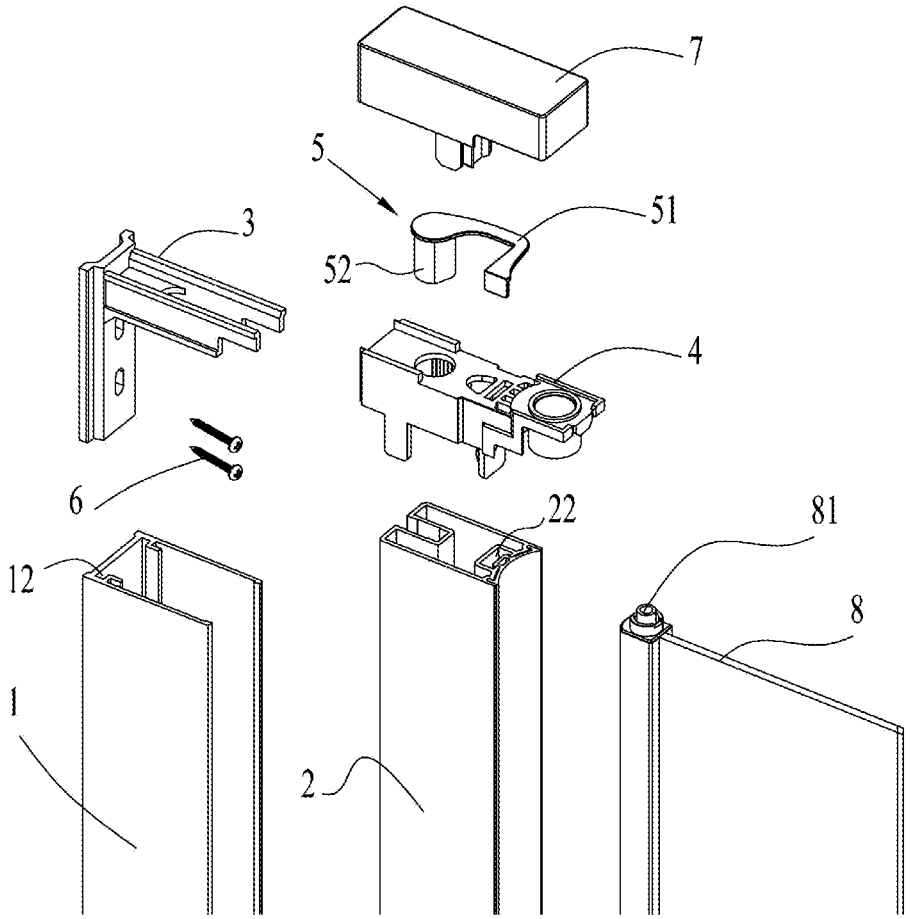
FIG. 1 shows a partly detached view of an exemplary door assembly according to embodiment of the invention.

FIG. 1 shows an exemplary door assembly which is a pivot door assembly used generally in a bathroom. The pivot door assembly comprises a fixing frame 1, a movable frame 2 and an adjusting assembly for fixing and adjusting the movable frame 2. The adjusting assembly further comprises a fixing element 3, an adjusting element 4 and a locking member 5. The fixing element 3 is disposed at one end of the fixing frame 1, and the adjusting element 4 is disposed at one end of the movable frame 2.

Figure 2:
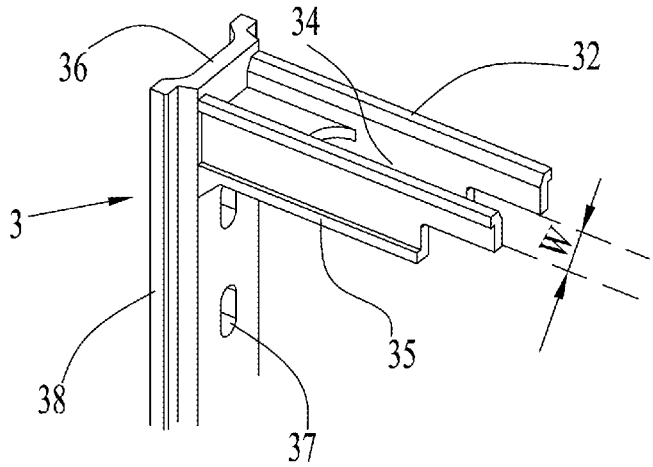
FIG. 2 shows a perspective view of a fixing element shown in FIG. 1.

In one exemplary embodiment shown in FIG. 2, the fixing element 2 includes an engagement element 32 on which a first groove 34 is formed for receiving at least one part of the locking member 5, which will be described in detail below. In a preferred embodiment, the fixing element 3 further includes a fixing plate 36 perpendicular to the engagement element 32. The fixing element 3 is attached to the fixing frame 1 by a fastener (for example, a screw) through a hole 37 formed in the fixing plate 36.

In another preferred embodiment of the present invention, a guiding portion 38 is disposed at two sides of the fixing plate 36, and correspondingly a second groove 12 is formed inside the fixing frame 1. The guiding portion 38 can be inserted into the second groove 12 to initially position the fixing element 3.

Figure 3A:
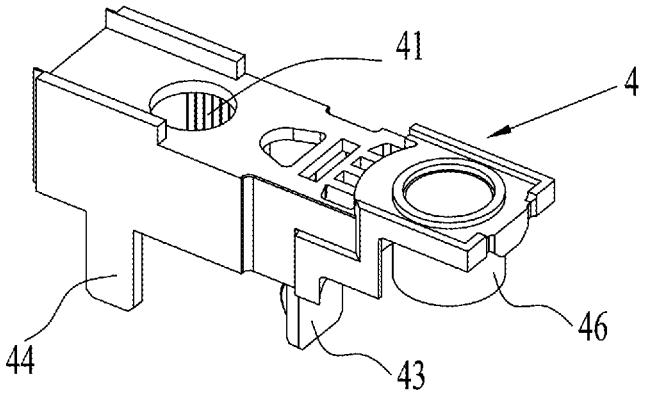
FIGS. 3*a* and 3*b* show different perspective views of an adjusting element shown in FIG. 1.
Figure 3B:
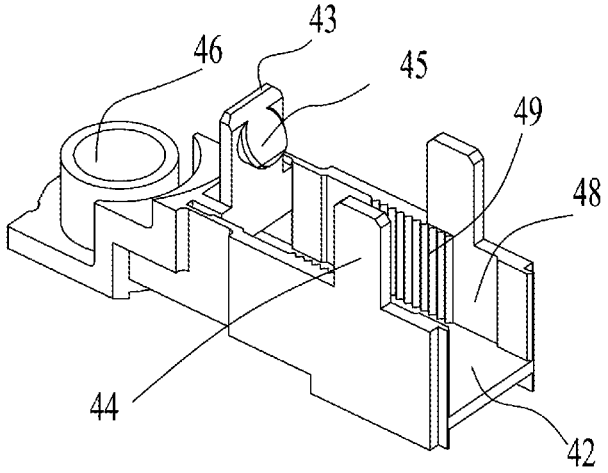

According to one embodiment of the present invention shown in FIGS. 3*a* and 3*b*, the adjusting element 4 comprises a cavity 42 for receiving the engagement element 32 and a first through hole 41 corresponding to the first groove 34. The position of the first through hole 41 relative to the first groove 34 is arranged such that at least one part of a rotation portion 52 of the locking member 5 is disposed within the first groove 34 after the rotation portion 52 goes through the first through hole 41, which will be described in detail below.

In one preferred embodiment of the present invention, a protrusion 43 is disposed on the adjusting element 4, and correspondingly a third groove 22 is formed inside the movable frame 2. The protrusion 43 can be inserted into the third groove 22 such that the adjusting element 4 is attached to one end of the movable frame 2. The adjusting element 4 can have a further protrusion 44 which can be inserted into a further groove 23 which is also formed inside the movable frame 2, as shown in FIG. 4.

Figure 4:
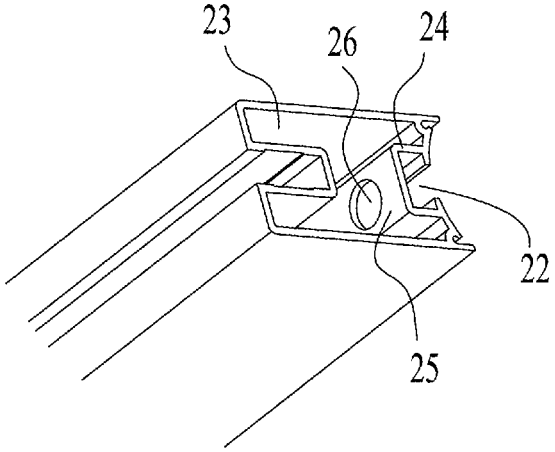
FIG. 4 shows a detailed view of an end portion of a movable frame shown in FIG. 1.

In one more preferred embodiment of the present invention shown in FIG. 4, the third groove 22 is formed by two lateral walls 24 and a transverse wall 25. A second through hole 26 is formed in the transverse wall 25, and correspondingly a snapping member 45 is disposed on one side of the protrusion 43. The snapping member 45 can be inserted into the second through hole 26 when the protrusion 44 has been inserted into the third groove 22 to prevent the adjusting element 4 from displacing with respect to the movable frame 2.

In one embodiment of the present invention, a shaft hole 46 is formed in the adjusting element 4. A rotation shaft 81 of the pivot door 8 can be inserted into the shaft hole 46 such that the pivot door 8 can be rotated about the rotation shaft 81.

In one embodiment of the present invention, the locking member 5 includes a handle portion 51 and rotation portion 52 as shown in FIG. 1. The handle portion 51 is arranged for applying a torque to rotate the rotation portion 52. The rotation portion 52 can go through the first through hole 41 of the adjusting element 4 such that at least one part of the rotation portion 52 is disposed within the first groove 34.

The rotation portion 52 has a cross section in shape of rectangle or ellipse. In a preferred embodiment, the cross section of the rotation portion 52 is in shape of rectangle with rounded corners. The rectangle cross section has short edges with a width less than width W of the first groove 34, and long edges with a length greater than width W of the first groove 34. When the locking member 5 is in a opening position where the short edges are perpendicular to inner walls of the first groove 34, the rotation portion 52 will not act on the inner walls of the first groove 34 and thus there is no contact between outer walls 35 of the engagement element 32 and inner walls 48 of the cavity 42 such that the adjusting element 4 is movable relative to the fixing element 3, when the locking member 5 is in a locking position where the long edges are perpendicular to the inner walls of the first groove 34, the rotation portion 52 can act on the inner walls of the first groove 34 and thus the outer walls 35 of the engagement element 32 can engage with the inner walls 48 of the cavity 42 such that the adjusting element 4 is attached to the fixing element 3.

Figure 5:
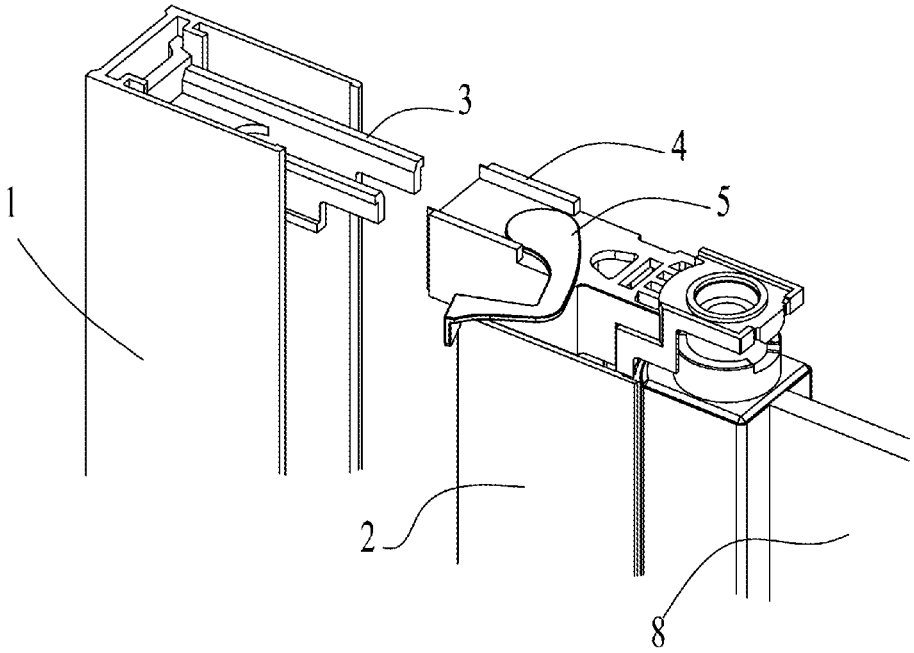
FIG. 5 shows a schematic view of the door assembly shown in FIG. 1 during assembling.
Figure 6:
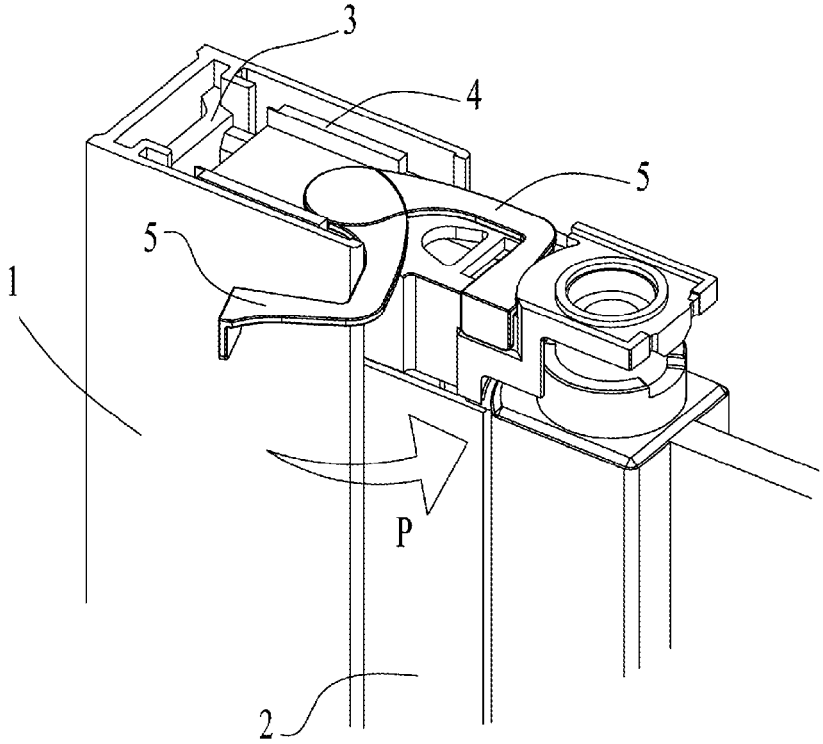
FIG. 6 shows another schematic view of the door assembly shown in FIG. 1 during assembling.

FIGS. 5 and 6 respectively show different schematic views of the door assembly during assembling. Firstly, the fixing frame 1 is fixed to a wall surface of the bathroom and the fixing element 3 is attached to the fixing frame 1. Secondly, the adjusting element 4 is attached to one end of the movable frame 2 and the pivot door 8 is pivoted to the adjusting element 4. Finally, the engagement element 32 of the fixing element 3 is inserted into the cavity 42 of the adjusting element 4 and the rotation portion 52 of the locking member 5 projects into the first groove 34 of the engagement element 32 through the first through hole 41. The locking member 5 is rotated from the opening position to the locking position, as indicated by arrow P, such that the adjusting element 4 is attached to the fixing element 3.

In one preferred embodiment of the present invention, the adjusting assembly is disposed both at the top and bottom ends of the pivot door to simultaneously adjust the same.

In one preferred embodiment of the present invention, at least one of the outer walls 35 of the engagement element 32 and at least one of the inner walls 48 of the cavity 42 have teeth respectively which are cooperating with each other. When the locking member 5 is moved from the opening position to the locking position, the teeth of the outer walls 35 can cooperate with that of the inner walls 48 to prevent the adjusting element 4 from displacing relative to the fixing element 3 in case of excessive force applied.

Figure 7A:
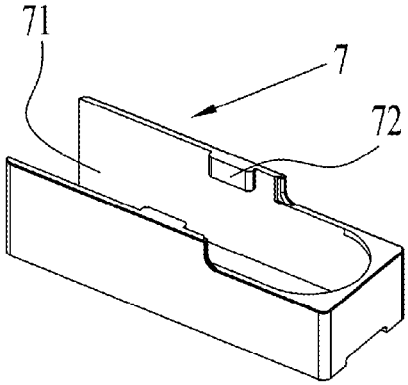
FIGS. 7*a* and 7*b* respectively show an exemplary cap and an exemplary adjusting element according to one embodiment of the invention.
Figure 7B:
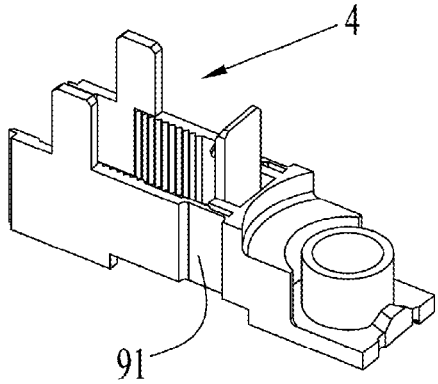

In one embodiment of the present invention, the pivot door assembly further comprises a cap 7 for partly surrounding the adjusting assembly to prevent water or dust from entering into the later. As shown in FIGS. 7*a* and 7*b*, the cap 7 includes a cavity 71 for accommodating the adjusting assembly. A lug 72 is disposed on a side surface of the cavity 71, and correspondingly a slot 91 is formed in an outer wall of the adjusting element 4. The lug 72 can be inserted into the slot 91 such that the cap 7 can be attached to the adjusting element 4.

Figure 8A:
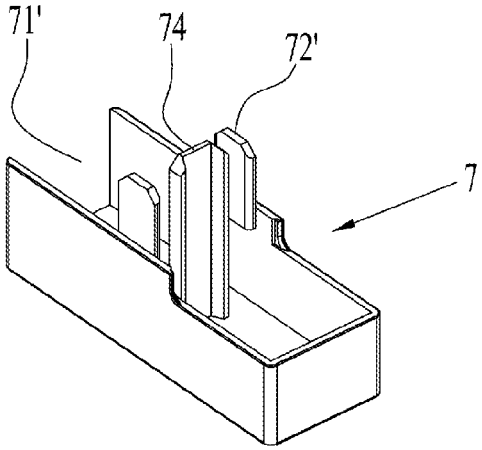
FIGS. 8*a* and 8*b* respectively show an exemplary cap and an exemplary adjusting element according to another embodiment of the invention.
Figure 8B:
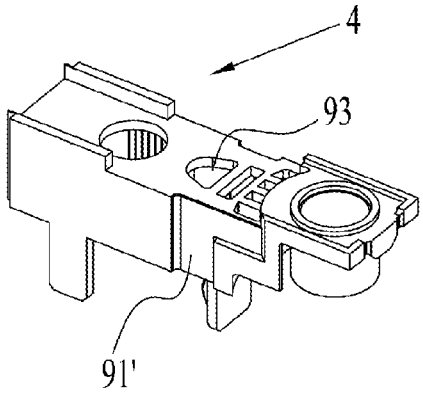
Figure 9:
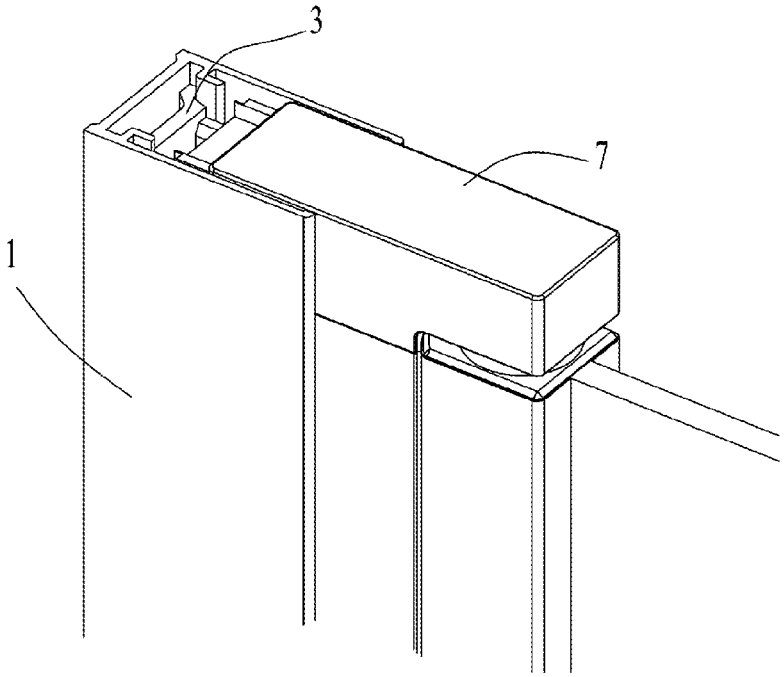
FIG. 9 shows a schematic view of the door assembly shown in FIG. 1 after being assembled.

FIGS. 8*a* and 8*b* respectively show another embodiment of the cap 7. The cap 7 includes a cavity 71' on a bottom surface of which a protrusion 74 is disposed. Correspondingly, in the adjusting element 4 is formed a through hole 93 into which the protrusion 74 can be inserted such that the cap 7 is attached to the adjusting element 4. It is possible for a person in the art to simultaneously dispose a lug 72' and the protrusion 74 on the cap 7 and correspondingly to simultaneously form a slot 91' and the through hole 93 in the adjusting element 4 to attach the cap 7 to the adjusting element 4. FIG. 9 shows a pivot door assembly with the cap 7 after being assembled.

It should be understood that various example embodiments have been described with reference to the accompanying drawings in which only some example embodiments are shown. The present invention, however, may be embodied in many alternate forms and should not be construed as limited to only the example embodiments set forth herein.

What is claimed is:

1. A door assembly comprising a stationary frame and a movable frame, wherein the door assembly further comprises an adjusting assembly for fixing and adjusting the movable frame, comprising a fixing element disposed at one end of the fixing frame and including an engagement element on which a first groove is formed;

an adjusting element disposed at one end of the movable frame and including a first through hole corresponding to the first groove and a cavity for receiving the engagement element; and a locking member comprising a handle portion and a rotation portion which can go through the first through hole such that at least one part of the rotation portion can reach in the first groove;

wherein the adjusting element is movable with respect to the fixing element when the handle portion is forced such that the locking member is in an opening position, and the rotation portion can cause outer sidewalls of the engagement element to engage with inner sidewalls of the cavity to lock the adjusting element when the handle portion is forced such that the locking member is in a locking position.

2. The door assembly as in claim 1, wherein the rotation portion has a cross section in shape of rectangle or ellipse.

3. The door assembly as in claim 1, wherein the outer sidewalls of the engagement element and the inner sidewalls of the cavity have teeth respectively which are cooperating with each other.

4. The door assembly as in claim 1, wherein the fixing element further includes a fixing plate perpendicular to the engagement element and connected to the fixing frame by a fastener.

5. The door assembly as in claim 4, wherein a guiding portion is disposed at two sides of the fixing plate, and a second groove is formed inside the fixing frame, the guiding portion being insertable into the second groove.

6. The door assembly as in claim 1, wherein a protrusion is disposed on the adjustable element, and a third groove is formed inside the movable frame, the protrusion being insertable into the third groove.

7. The door assembly as in claim 6, wherein the third groove include two lateral walls and a transverse wall in which a second through hole is formed, and a snapping member is disposed on the protrusion, the snapping member being insertable into the second through hole.

8. The door assembly as in claim 1, wherein the adjusting element further includes a shaft hole cooperating with a rotation shaft of a door such that the door is rotatable about the rotation shaft.

9. The door assembly as in claim 1, wherein the door assembly further comprises a cap for partly surrounding the adjusting assembly.

10. The door assembly as in claim 1, wherein the door assembly is shower door assembly or balcony assembly.

* * * * *